United States Patent [19]

Uchida et al.

[11] Patent Number: 4,605,177

[45] Date of Patent: Aug. 12, 1986

[54] BOBBIN TRANSPORTING AND TREATING SYSTEM

[75] Inventors: Hiroshi Uchida, Oumihachiman; Kazuo Nakanishi, Uji; Yoshihiko Kawasaki, Kyoto, all of Japan

[73] Assignee: Murata Kikai Kabushiki Kaisha, Japan

[21] Appl. No.: 652,338

[22] Filed: Sep. 19, 1984

[30] Foreign Application Priority Data

Sep. 20, 1983 [JP] Japan ..... 58-173689
Sep. 21, 1983 [JP] Japan ..... 58-174843
Sep. 21, 1983 [JP] Japan ..... 58-174845

[51] Int. Cl.[4] ..... B65H 54/20; B65H 67/06

[52] U.S. Cl. ..... 242/35.5 A

[58] Field of Search ..... 242/35.5 A, 35.5 R, 242/35.6 R

[56] References Cited

U.S. PATENT DOCUMENTS 3,195,298 7/1965 Furst ..... 242/35.5 R X
3,480,216 11/1969 Iannucci et al. ..... 242/35.5 R X
3,538,990 11/1970 Brouwer et al. ..... 242/35.5 A X
3,991,894 11/1976 Matsui et al. ..... 242/35.5 R X
4,144,961 3/1979 Kasahara et al. ..... 242/35.5 A X
4,181,228 1/1980 Hashimoto et al. ..... 242/35.5 A X
4,463,909 8/1984 Kiriake et al. ..... 242/35.5 A
4,480,740 11/1984 Wurmli ..... 242/35.5 A X

FOREIGN PATENT DOCUMENTS 157678 9/1983 Japan ..... 242/35.5 A
162465 9/1983 Japan ..... 242/35.5 A

*Primary Examiner*—Stanley N. Gilreath
*Attorney, Agent, or Firm*—Spensley Horn Jubas & Lubitz

[57] ABSTRACT

A bobbin transporting and treating system in winder. A spinning bobbin is erectly fitted on a carrier and is transported to a yarn end finding device, winding unit, a remover for pulling an empty bobbin off from the carrier, and a spinning bobbin feeder along a transporting path which is formed to be closed loops and includes a bobbin supplying path, a returning path and a bypass circuit for storing a bobbin from which yarn ends have not been picked up successfully.

10 Claims, 8 Drawing Figures

BOBBIN TRANSPORTING AND TREATING SYSTEM

BACKGROUND OF THE INVENTION

1. Field of the Invention

This invention relates to a bobbin transporting system, and more particularly to a bobbin treating and transporting system in an apparatus for supplying to and discharging from a winder bobbins fitted on carriers which system is suitable for finding ends of yarns on spinning bobbins or for treating empty bobbins and bobbins with small amount of yarn or some remaining yarns, that is, partial-bobbins discharged from the winder.

2. Prior Art

In supplying a winder with a bobbin on which a spun yarn is wound, an end of a yarn wound on a bobbin, that is, a spinning bobbin, is found and picked up by a yarn end finding device. On occasion, the end of yarn is insufficiently drawn from the bobbin even after processing by the yarn end finding device. This may occur, for example, with bobbins which are delivered from a spinning frame to a winder. It may also occur with empty bobbins or bobbins having a residual amount of yarn thereon which are sorted for possible redelivery to the winder. From such bobbins, yarn may not be unwound satisfactorily even after a number of repetitive yarn end finding operations. Accordingly, the yarn ends of such bobbins must be picked up and manually adjusted to prepare the bobbins for subsequent processing.

SUMMARY OF THE INVENTION

It is an object of the present invention to provide a bobbin transporting system which can introduce spinning bobbins into different transporting paths in accordance with the condition of the bobbin in order that such bobbins may be regularly and efficiently fed to respective positions at which they are to be treated, regardless of whether the ends of yarns thereon are picked up completely or not, or whether there are remaining yarns thereon.

According to the present invention, there is provided a bobbin transporting system for feeding to a winder bobbins from which ends of yarn have been found and picked up by a bobbin yarn end finding device and for returning empty bobbins and bobbins having a residual amount of yarn thereon to the winder to sort them in order to find and pick up ends of yarns. A closed loop is provided for delivering bobbins to the winder and a returning path is provided for accepting bobbins from the winder. A bypass circuit is provided in parallel relationship to the closed loop so that, spinning bobbins and bobbins having a residual amount of yarn thereon may be stored in the bypass circuit to allow manual adjustment of those bobbins from which yarn ends have not been picked up completely.

By locating a new bobbin supplying station in advance of the yarn end finding device and locating a remover for pulling a bobbin off a carrier in advance of the new bobbin supplying station, reserving passages can be formed directly in advance of each of the devices, thereby allowing for a smooth flow of bobbins to each of the devices.

Meanwhile, spinning bobbins from which ends of yarns have not been picked up completely are automatically fed back to the yarn end finding device again, but spinning bobbins from which yarn ends cannot possibly be picked up will circulate the circuit several times, resulting in a problem of reduction in a treating efficiency of the yarn end finding device.

Accordingly, in order that bad spinning bobbins from which ends of yarns cannot be picked up by the yarn end finding device may be discharged outside the transporting path system so as to allow concentrated treatment of such spinning bobbins such as adjustment, the bobbin transporting system of the invention is constituted such that all spinning bobbins in the bypass circuit can be periodically discharged outside the transporting path system by means of the remover either when a present number of spinning bobbins from which yarn ends have not been picked up completely appear in succession or each time a predetermined period of time elapses.

In addition, according to the invention, the bobbin transporting system can be constituted such that, either when incomplete picking up of a yarn end occurs in succession for a preset number of spinning bobbins or each time a predetermined period of time elapses, all spinning bobbins in the bypass circuit from which yarn ends have not been picked up completely are discharged outside the transporting path system by means of the remover for pulling bobbins off to allow concentrated treatment of such spinning bobbins such as adjustment, and after such spinning bobbins in the bypass circuit have been adjusted by an operator, all of them can be fed toward the yarn end finding device.

DETAILED DESCRIPTION OF THE INVENTION

Figures 1, 2:
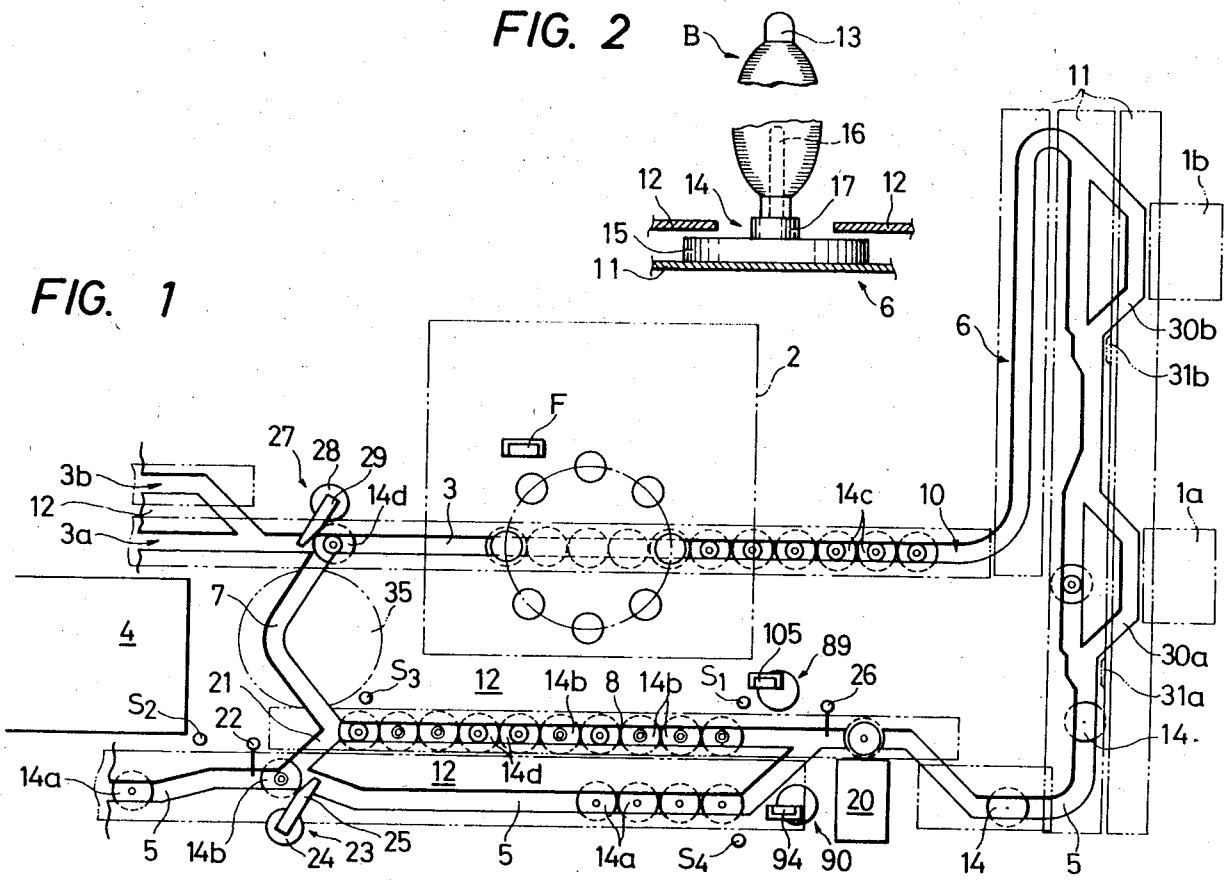
FIG. 1 is a plan view showing a general construction of a bobbin transporting and treating device.
FIG. 2 is a cross sectional view of a transporting path.

Now, preferred embodiments of a bobbin transporting system of the present invention will be described in detail with reference to the accompanying drawings.

A first embodiment will first be described with reference to FIG. 1.

A bobbin transporting system of the present invention includes a transporting path 6 including a supplying path 3 for feeding to a winder 4 via a bobbin yarn end finding device 2 spinning bobbins B which are received at bobbin supplying stations 1*a* and 1*b* and a returning path 5 for returning to the bobbin yarn end finding device 2 empty bobbins, small amount of yarn bobbins (i.e., those bobbins having a residual amount of yarn thereon which are not suitable for return to the winder) and partial-bobbins (i.e., those bobbins having a residual amount of yarn thereon which are suitable for return to the winder) after completion of unwinding of yarns thereon. A bobbin discharging path 7 for discharging bobbins from which yarn ends have not been picked up completely and a bypass circuit 8 contiguous to the bobbin discharging path 7 are provided between the bobbin supplying path 3 and the returning path 5, thereby forming a closed loop 10.

The closed loop 10 includes a first closed loop comprising the bobbin supplying path 3 for transporting spinning bobbins from the bobbin yarn end finding device 2 to the winder 4 and the returning path 5 for feeding back to the bobbin yarn end finding device carriers carrying empty bobbins 14*a*, carriers carrying small amount of yarn bobbins 14*b*, and carries carrying partial-bobbins 14*d* which are discharged from the winder 4, the returning path 5 being connected to the bobbin supplying path 3 through a path provided between winding units; a second closed loop comprising the bobbin supplying path 3, the carrier discharging path 7 branched from the bobbin supplying path 3 for discharging carriers carrying bobbins from which yarn ends have not been picked up successfully, the bypass circuit 8 connected to the carrier discharging path 7 and the returning path 3 to which a terminal end of the bypass circuit 8 is connected; and a third closed loop comprising the bobbin supplying path 3, the bypass circuit 8, the returning path 5 and branched paths connecting a beginning end and the terminal end of the bypass circuit 8 to the returning path 5 to replace a part of the first closed loop with the bypass circuit 8.

The transporting path 6 includes a belt conveyor 11 and a pair of spaced guide plates 12 extending in parallel relationship to the belt conveyor 11 and is adapted to transport carriers 14 with bobbins 13 fitted uprightly thereon which are placed on the belt conveyor 11. Each of such carriers 14 includes a base plate 15 in the form of a disk and a peg 16 implanted at the center of the base plate 15, and while it is transported, a bobbin 13 is fitted uprightly on the peg thereof and a base portion 17 of the peg 16 is positioned between the guide plates 12.

A remover 20 for pulling an empty bobbin off an empty bobbin carrier 14*a* is located at a joining point between the bypass circuit 8 and the returning path 5 of the closed loop 10. An entrance of the bypass circuit 8 is communicated with the returning path 5 by way of branch path 21. A feeler 22 is located adjacent an entrance to the branch path 21 from the returning path 5. The feeler 22 is provided for detecting if there is a bobbin with a remaining yarn or an empty bobbin and identifies an amount of a layer of yarn on a bobbin in accordance with a swinging angle of a detecting wire contacting with a farce of the yarn layer. Thus, if the swinging angle of the detecting wire is relatively large, then a bobbin having a yarn layer thereon is determined, and on the contrary, if there is no swing of the detecting wire, a bobbin with no yarn layer is determined and thus an empty bobbin carrier selecting device 23 is rendered operative. The empty bobbin carrier selecting device 23 includes a solenoid 24 and a bar 25 which is extended into the returning path 5 as seen in FIG. 1 in response to a signal representing presence of a remaining yarn from the feeler 22 to cause the bobbin carrier 14*b* with a remaining yarn which has advanced thereto along the returning path 5 to be introduced into the branch path 21. A similar feeler 26 is located forwardly of the remover 20 so that it may detect an empty bobbin carrier 14*a*, and when an empty bobbin carrier 14*a* is detected, the feeler 26 renders the remover 20 operative to remove an empty bobbin from the empty bobbin carrier 14*a*.

A bobbin carrier selecting device 27 for selecting a bobbin from which an end of a yarn has not been picked up successfully is located adjacent an entrance of the bobbin discharging path 7. The bobbin carrier selecting device 27 has a same construction as the empty bobbin carrier selecting device 23 and is adapted to detect whether the finding and picking up of an end of a yarn has been completed at the bobbin yarn end finding device 2, that is, whether an end of a yarn has been drawn out completely from a bobbin. In response to a signal representative of absence of an end of a yarn, a solenoid 28 is rendered operative to project a bar 29 into the bobbin supplying path 3 to cause a bobbin carrier 14*d* carrying a bobbin from which a yarn end has not been picked up successfully to be introduced into the bobbin discharging path 7.

The bobbin supplying stations 1*a* and 1*b* are located between the bobbin yarn end finding device 2 and the remover 20 of the closed loop 10. The arrangement shown in the drawings includes two sets of such stations 1*a* and 1*b* so as to allow supply of two kinds of bobbins. A bypass 30*a* or 30*b* is provided for each of the bobbin supplying stations 1*a* and 1*b*, respectively, and located at an entrance of each of the bypasses 30*a* and 30*b* is a selecting device 31*a* or 31*b* for selectively introducing empty carriers into the bypass 30*a* or 30*b*, respectively. Another selecting device (not illustrated) for selecting carriers onto which bobbins are to be supplied at the bobbin supplying station 1*a* is located at an entrance of the bobbin supplying station 1*a*.

At the individual bobbin supplying stations 1*a* and 1*b*, different particular bobbins are fitted onto carriers 14. Such carriers 14 have predetermined different marks applied thereto, and at the bobbin supplying stations 1*a* and 1*b*, carriers having corresponding marks are supplied with bobbins.

Now, description will be given of operations of the bobbin transporting system of the present invention.

A carrier 14 to which a new bobbin of a first kind is supplied at the bobbin supplying station 1*a* is not introduced into the bypass 30*a* for the selecting device 31*a* but advances straightforwardly along the closed loop 10 as the belt conveyor 11 circulates until it is admitted by the bobbin yarn end finding device 2 at which an end of a yarn on the bobbin is found and picked up. In the meantime, another carrier 14 to which a new bobbin of a second kind is supplied at the bobbin supplying station 1*b* leaves the bypass 30*b* and enters and advances along the closed loop 10 until it is admitted into the bobbin yarn end finding device 2 at which an end of a yarn on the bobbin is found and picked up. A carrier carrying a spinning bobbin after completion of picking up of an end of a yarn thereon is then fed to the winder 4 by way of the bobbin supplying path 3. While the carrier is thus fed to the winder 4, it is detected in accordance with the presence or absence of an end of a yarn picked up whether picking up of a yarn end has been effected regularly, and a carrier carrying a spinning bobbin from which a yarn end has been picked up regularly is not selected by the bobbin selecting device 27 and thus advances straightforwardly. Thus, carriers which have been selected by the selecting device (not shown) and carry bobbins of the first kind thereon are selectively introduced into the bobbin supplying path 3*a* leading to the winder 4 for winding yarns from bobbins of the first kind while carriers which carry bobbins of the second kind thereon are selectively introduced into the bobbin supplying path 3*b* leading to the different winder 4 for winding yarns from the bobbins of the second kind.

On the other hand, a carrier 14*d* carrying a bobbin from which an end of a yarn has not been picked up regularly at the bobbin yarn end finding device 2 and hence the presence of a yarn end picked up has not been identified is prevented from advancing straightforwardly and is thus introduced into the bobbin discharging path 7 by the bar 29 which has been projected into the bobbin supplying path 3 by operation of its solenoid 28 of the bobbin selecting device 27 caused in response to a signal representative of incomplete picking up of a yarn end for the bobbin on the carrier 14*d*. The bobbin carrier 14*d* thus introduced into the bobbin discharging path 7 is then introduced into the bypass circuit 8 as a disk 35 rotates, and when a sensor S1 detects the bobbin carrier 14*d*, a stopper is rendered operative to stop the bobbin carrier 14*d* within the bypass circuit 8.

Meanwhile, carriers 14 from which yarns have been unwound at the winders 4 are discharged from the winder 4 into the returning path 5 and is thus circulated back along the returning path 5. Among such carriers 14, there exist, in intermixed conditions, carriers 14*a* carrying empty bobbins, carriers 14*b* carrying small amount of yarn bobbins, and carriers 14*d* carrying partial-bobbins. Those bobbins are sorted by means of the empty bobbin carrier selecting device 23.

In particular, in response to detection by means of the sensor S2 of returning of a carrier 14 along the returning path 5, the stopper stops the carrier 14 for a predetermined period of time (a period of time required for selection by the empty bobbin carrier selecting device 23 as described hereinafter) whereafter the carrier 14 is released to advance further. Then, if the feeler 22 detects that there remains a yarn on the bobbin, the solenoid 24 of the empty bobbin carrier selecting device 23 is rendered operative to project the bar 25 into the returning path 5. The bobbin on which a remaining yarn is detected must be introduced into the bypass circuit 8. Thus, a carrier 14*b* carrying a partial-bobbin is abutted against the bar and is introduced thereby into the branch path 21 and then into the bypass circuit 8.

Thus, when a sensor S3 detects that the bypass circuit 8 is filled with carriers 14*d* carrying bobbins from which yarn ends have not been picked up successfully and carriers 14*b* carrying partial-bobbins which have been delivered into the bypass circuit 8 from the bobbin yarn end finding device 2 and the winder 4 in this manner, a stopper located adjacent the sensor S1 is moved open while another stopper located adjacent a sensor S4 is moved into a closed position. As a result, the carriers 14 in the bypass circuit 8 begin their advancement while the carriers 14 in the returning path 5 are stopped. While the bobbins are held stopped in the bypass circuit 8, they are manually adjusted so as to allow later complete picking up of yarn ends thereon. The carrier 14 thus permitted to advance is detected by the feeler 26 that there is a layer of a yarn on the bobbin thereon and thus advances directly to the bobbin supplying station 1. Then, it is selected by the selecting device 31*b* as a carrier carrying a bobbin with a yarn layer and advances straightforwardly. Then, it is selected in a similar manner by the selecting device 31*b* again as a carrier carrying a bobbin with a yarn layer and advances straightforwardly in a similar manner. As a result, the carrier 14 is fed to the bobbin yarn end finding device 2 at which an end of a yarn is found and picked up again.

Meanwhile, a carrier 14*a* carrying an empty bobbin or a carrier 14*c* carrying a small amount of yarn bobbin which has been selected by the empty bobbin carrier selecting device 23 and has thus advanced straightforwardly along the returning path 5 is then detected once by the sensor S4 as it arrives at a position adjacent thereto, and then after it has been held stopped for a predetermined period of time (after lapse of a period of time required for a cycle of operations of the remover 20), it is fed to the remover 20. Here, it is detected by the feeler 26 if there remains a yarn layer on the bobbin or not, and if an empty bobbin or a small amount of yarn bobbin is determined, the remover 20 is rendered operative to remove the bobbin from the carrier 14. The thus emptied carrier is then fed to the bobbin supplying station 1, and here, as the selecting device 31*a* detects from the mark on the carrier that the carrier is empty and is a carrier to which a bobbin is to be supplied at the bobbin supplying station 1*a*, the carrier is introduced into the bypass 30*a* so that a bobbin of the first kind is supplied to the carrier at the bobbin supplying station 1*a*. After then, the carrier is introduced into the closed loop 10 again. An empty carrier for a bobbin of the second kind which has not been selected at the selecting device 31*a* is then selected at the selecting device 31*b* and is thus supplied with a bobbin of the second kind at the bobbin supplying station 1*b* whereafter it is introduced into the closed loop 10.

As has been described in detail so far, a bobbin transporting system according to the present invention comprises a bobbin supplying path for feeding out spinning bobbin carriers from a bobbin yarn end finding device to a winder, a returning path for feeding carriers carrying empty bobbins, carriers carrying small amount of yarn bobbins and carriers carrying partial-bobbins from the winder back to the bobbin yarn end finding device, a carrier discharging path for discharging carriers carrying bobbins from which ends of yarns have not been picked up successfully, the carrier discharging path being branched from the bobbin supplying path, a bypass circuit connected to the carrier discharging path and having a terminal end thereof connected to the returning path thereby to form a closed loop, a bobbin carrier selecting device located at a branching point of the carrier discharging path for selecting carriers carrying bobbins from which ends of yarns have not been picked up successfully, a branch path connecting a beginning end of the bypass circuit to the returning path, an empty bobbin carrier selecting device located at a crossing position between the returning path and the branch path, a remover located at a joining point between the bypass circuit and the returning path, and a bobbin supplying station located between the remover and the bobbin yarn end finding device. Accordingly, bobbins from which yarn ends have not been picked up successfully and partial-bobbins which have returned from the winder can be stored in a stand-by condition in the bypass circuit constituted in the closed loop so that causes of such unsuccessful picking up of yarn ends on bobbins, causes of such partial-bobbins and so on can be removed manually while the bobbins are held in the bypass circuit.

In addition, since the returning path extends between the remover and the bobbin supplying station, the returning path forms a reserving passage, and particularly since the bypass circuit and the returning path parallel thereto extend long, the returning path presents a great effect as a reserving passage. Accordingly, even if treatment of carriers at the remover and so on is delayed, carriers can be held in a stand-by condition in the reserving passage, thereby preventing reduction of the working property of the carriers transporting system and smoothing a flow of carriers in the carrier transporting system. Now, description wll be given with reference to FIG. 1 of a process for discharging bobbins in the bypass circuit outside the transporting path system using the remover either when a preset number of bobbins from which ends of yarns have not been picked up successfully appear in succession or each time a predetermined period of time elapses.

Figure 3:
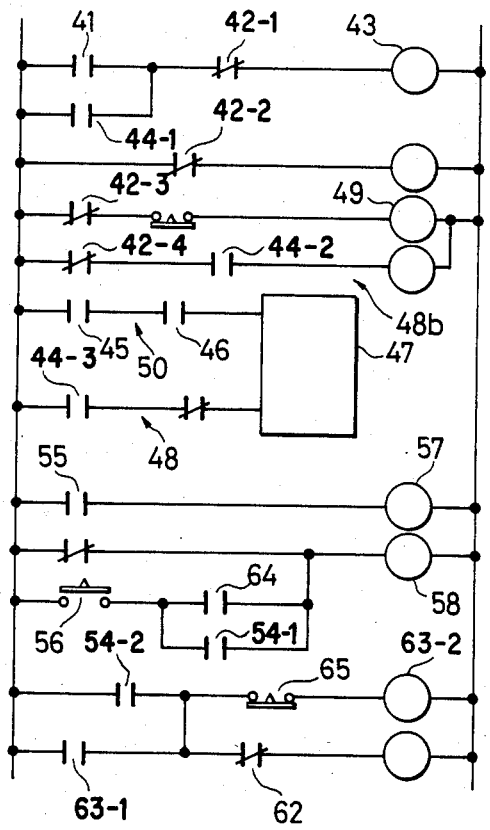
FIG. 3 is an electrical circuit diagram of principal part for putting into practice a method of discharging, when a predetermined number of spinning bobbins from which yarns have not been picked up completely continue, such spinning bobbins outside a transporting path.
Figure 4:
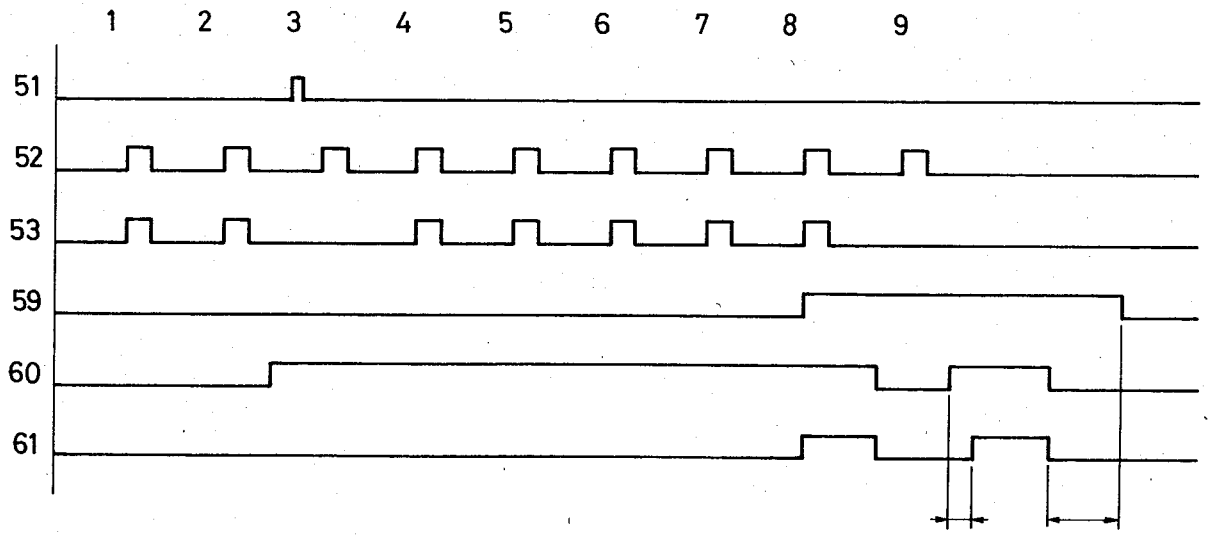
FIG. 4 is a time chart of the electrical circuit diagram.

At first, description will be given of a case in which ends of yarns on bobbins are not successfully picked up in succession by the yarn end finding device 2. An electrical circuit diagram of the part of the bobbin transporting system which is designed to discharge all of bobbins in the bypass circuit 8 outside the transporting path system when ends of yarns on five successive bobbins are not picked up successfully is illustrated in FIG. 3 and a timing chart of the electrical circuit is illustrated in FIG. 4. From a spinning bobbin B supplied from the transporting path 6 to the yarn end finding device 2, an end of a yarn is found and picked up by the yarn end finding device 2. Whether such picking up of a yarn end has been effected successfully or unsuccessfully is detected by the picking up detecting feeler F which operates each time a cam shaft of the yarn end finding device 2 makes a rotation. Referring to FIG. 3, the circuit includes a switch 41 of the yarn end picking up detecting feeler F, switches 42-1, 42-2, 42-3 and 42-4 which simultaneously operate upon actuation of the cam shaft of the yarn end finding device 2 operates, an instrument 43 for detecting successful picking up of a yarn end on a bobbin, and switches 44-1, 44-2 and 44-3 which are simultaneously closed when the instrument 43 detects successful picking up of a yarn end. The circuit further includes switches 45 and 46 for inputting unsuccessful picking up of a yarn end to a counter 47, and the switch 45 is closed each time a bobbin passes while the switch 46 is closed when unsuccessful picking up of a yarn end is detected. The circuit further includes a circuit for clearing a value held in the counter when successful picking up of a yarn end is detected. Now, if picking up of an end of a yarn on a first bobbin has failed, the resetting circuit **48*b* for the counter 47 does not operate since the switch 41 is left open to prevent input to the relay 43 while the switches 44-1, 44-2, and 44-3 are in the closed position. Meanwhile, an instrument 49 which has detected rotation of the cam shaft operates to close the switch 46 to thus connect, in cooperation with the switch 45 which is closed each time a bobbin passes, a setting circuit 50 to allow input to the counter 47. Referring to FIG. 4, an uppermost line 51 indicates a condition of the switch 41, and when successful picking up of a yarn end is detected, it presents a high level. A second uppermost line 52 indicates a condition of the switch 45 and presents a high level each time a bobbin passes, and a line 53 presents a high level when there is an input to the counter 27. Now, since picking up of a yarn end has failed for the first bobbin, the switch 41 does not operate and hence the line 51 does not present a high level. Meanwhile, since the first bobbin now passes, the line 52 presents a high level while the line 53 presents a high level since there is an input to the counter 47. Thus, the bobbin from which a yarn end has not been picked up completely is fed to the bobbin supporting path 3 and is then introduced into the bypass circuit 8 by the movable gate 29 which has been brought to a position in which it extends into the bobbin supplying path 3 by operation thereof in response to detection of the unsuccessful picking up of a yarn end. Then if a second bobbin also has a yarn end not picked up successfully, the electrical circuit operates in the same manner as in the case of the first bobbin and the lines of the timing chart present the respective same configurations. The second bobbin is also introduced into the bypass circuit 8 in a similar manner to the first bobbin. Then, if a succeeding third bobbin has a yarn end picked up successfully, the switch 41 is closed to allow input to the instrument 43 while the switches 44-1, 44-2, and 44-3 are closed to connect the resetting circuits 48*a* and 48*b*. Accordingly, there is no input allowed to the counter 47. Since the third bobbin has a yarn end picked up successfully, the line 51 in FIG. 4 presents a high level, and it is represented that there is no input to the counter 47. In this case, the bobbin fed to the bobbin supplying path 3 is not blocked by the movable gate 29 and hence advances through the transporting path communicating with the winder. Then, if five spinning bobbins from a fourth to an eighth bobbin have yarn ends not picked up successfully, they are all introduced into the bypass circuit 8. In this case, in the electrical circuit, there are five successive inputs to the counter 47 in a similar manner to the case of the first and second bobbins. As a result, the switches 54-1 and 54-2 are closed. A switch 55 is provided which detects a carrier at the bobbin remover 20, and a time switch 56 is also provided which is closed in response to detection of a carrier by an instrument 57. Thus, by closing of the switches 54-1, 54-2, and 56, an electric circuit for a bobbin mounting motor 58 is connected to carry out removal of the bobbins. In a word, referring to FIG. 1, bobbin carriers 14*d* introduced into the bypass circuit 8 from which yarn ends have not been picked up successfully are all removed when they are supplied to a position of the bobbin remover 20, and are discharged outside the transporting path system. FIG. 4 indicates that, when picking up of a yarn end has failed successively for the five bobbins from the fourth to the eighth, the line representing the output of the counter 47 presents corresponding high levels, representing operations of the counter 47. A line 60 presents a high level when presence of a carrier is detected at the bobbin remover 20, and a line 61 presents a high level when a bobbin remover motor operates. After all the bobbins in the bypass circuit 8 have been discharged outside the transporting path system, no bobbin led from which a yarn end has not been picked up successfully is supplied to the bobbin remover 20. Thus, if no bobbin is supplied to the bobbin remover 20 even after lapse of a predetermined period of time, a switch 62 is opened, and in response to a signal representing this, another switch 65 is opened while a contact 63-1 is closed to connect the resetting circuit 48 for the counter 47 to thus disconnect an output from the counter 47. Meanwhile, while bobbins in the bypass circuit 8 is being discharged, the contact 63-1 is held opened, and hence since the contact 63 is held opened in this manner if there is a bobbin from which a yarn end has been picked up successfully, the relay 63-2 for the resetting circuit 48 is left open and hence a resetting signal is prevented from being inputted to the counter 47. It is to be noted that a switch 64** in the electric circuit is provided for determination if a bobbin supplied to the bobbin remover 20 is an empty bobbin or not. This switch 64 is provided in order that, since the bobbin remover 20 is located in a system in which a bobbin 14*d* introduced into the bypass path 8 is circulated and is connected also to the returning path 5 for returning empty bobbins, spinning bobbins are normally circulated without being removed while only empty bobbins are removed from the system.

Subsequently, description will be given of a process of discharging all of bobbins in a branch path outside a transporting path system after lapse of a period of an hour.

Figure 5:
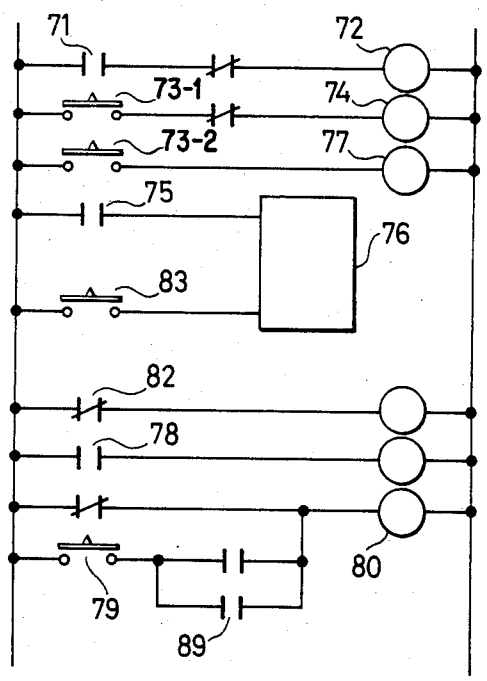
FIG. 5 is a circuit diagram of principal part for putting into practice a method of discharging a spinning bobbin from which an end of a yarn has not been picked up completely outside the transporting path system after lapse of a predetermined period of time.
Figure 6:
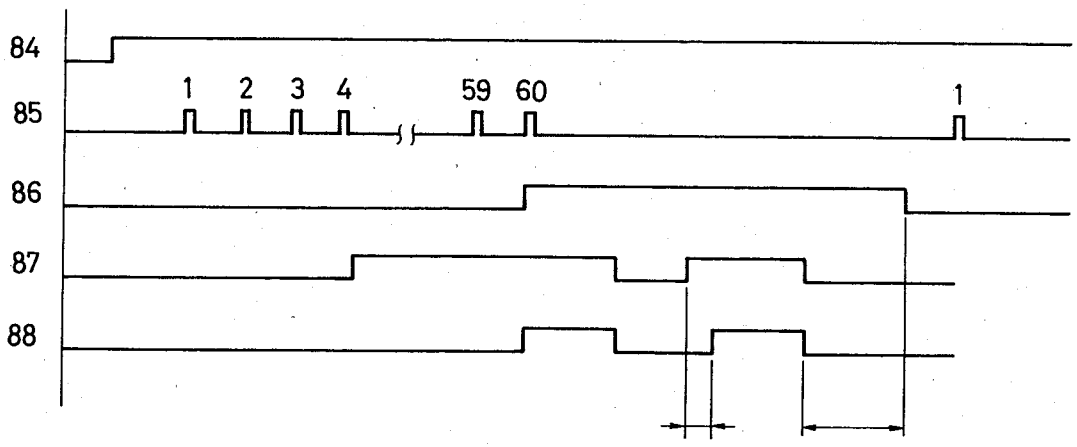
FIG. 6 is a time chart of the electrical circuit diagram of FIG. 5.

FIG. 5 is an electric circuit diagram of essential part of a bobbin transporting system, and FIG. 6 is a timing chart therefor. During running of the yarn end finding device 2, a switch 71 is always held closed. Thus, a timer switch 72 operates, and if a period of one minute elapses, the timer switches 73-1 and 73-2 are thrown in to render a relay 74 operative to turn a switch 75 on to allow input to a counter 76. Another relay 77 is turned on after a little delay from that of the relay 74 to thus open a contact 78 to disconnect input to the counter 76. As a result, a differentiation pulse is inputted to the counter 76. Accordingly, by repetition of this sequence of operations by 60 times 60 differentiation pulses are inputted one after another at one minute intervals to the counter 76. This means lapse of 60 minutes. If 60 differentiation pulses are inputted to the counter 76 in this way, a switch 89 is closed, and if presence of a carrier at the bobbin remover 20 is identified and the switch 78 is closed, the signal is transmitted to a timer switch 79. As a result, the switch 79 is closed to connect an electric circuit for a motor 80 to render the bobbin remover 20 operative to discharge the bobbin 14*d* from which a yarn end has not been picked up successfully outside the transporting path system. When a detecting feeler 81 located in the bypass circuit 8 for detecting a bobbin 14*d* from which a yarn end has not been picked up successfully detects that no bobbin 14*d* has passed for a predetermined period of time, a switch 82 is opened, and this signal is transmitted to a switch 83 to connect a resetting circuit for the counter 76, thereby disconnecting output of the counter 76. In other words, when bobbins 14*d* are all discharged from the bypass circuit 8 and there remain no more bobbins to be discharged, another measurement for a period of an hour is started. Description of a flow of bobbins in the arrangement of FIG. 1 is herein omitted since it is substantially the same as that in the first process described herein above. Referring to FIG. 6, an uppermost line 84 indicates a condition of the switch 71 and presents a high level while the yarn end finding device is operating whereas it presents a low level while the yarn end finding device is in a stopped condition. A second uppermost line 85 indicates generation of differentiation pulses at one minute intervals by high level configurations thereof. A line 86 indicates outputs of the counter 76 by high level configurations thereof, a line 87 indicates by high level configurations thereof that a carrier is positioned at the bobbin remover 20, and a line 88 indicates by high level configurations that a bobbin or bobbins 14*d* are being removed.

In this way, if a process of the present invention is applied to an apparatus which includes a transporting path system for automatically circulating bobbins from which ends of yarns have not been picked up successfully by way of a branch path again to a yarn end finding device, bad bobbins for which picking up of yarn ends has failed several times can be discharged outside the transporting path system, resulting in improvement in a treating efficiency of the yarn end finding device. Thus, such bad spinning bobbins from which yarn ends cannot be picked up can be subject to treatment such as adjustment in a concentrated manner, the process of the invention presents an effect that the working efficiency can be improved.

Now, description will be given of a mechanism which is designed to allow all of spinning bobbins in a bypass circuit from which bobbins ends of yarns have not been picked up successfully to be discharged outside the system by means of a remover for removing bobbins either when a preset number of bobbins for which picking up of a yarn end has failed appear in succession or each time a predetermined period of time elapses and which is also designed to deliver, directly after an operator has adjusted all of the bobbins in the bypass circuit from which bobbins yarn ends were not picked up successfully, all of the bobbins thus adjusted to a yarn end finding device preceding to any other empty bobbins.

Figure 7:
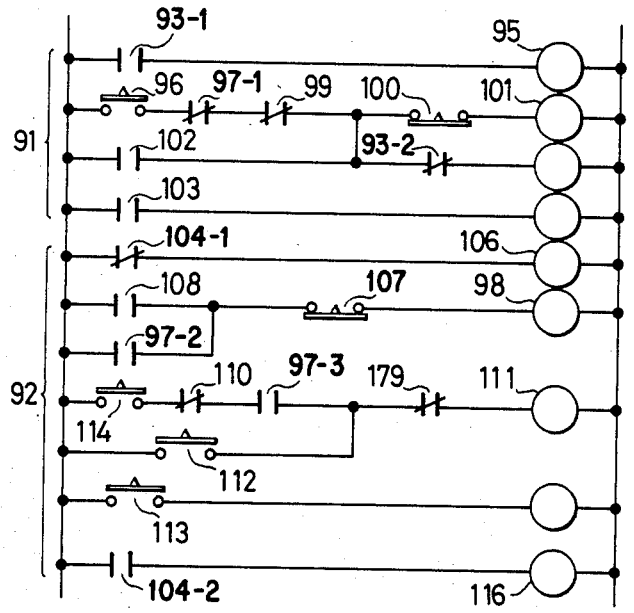
FIG. 7 is an electrical circuit diagram of a mechanism for delivering a corrected bobbin from which an end of a yarn has not been picked up completely.

The bobbin transporting and treating system shown in FIG. 1 further includes bobbin stopping mechanisms located adjacent an exit of the bypass circuit. In particular, a first bobbin stopping mechanism 89 is located adjacent the bypass circuit 8 forwardly of the joining point, and a second bobbin stopping mechanism 90 is located adjacent the returning path 5 forwardly of the joining point. The first and second bobbin stopping mechanisms 89 and 90 are electrically connected in an electronic circuit as shown in FIG. 7. Referring to FIG. 7, the electric circuit includes an empty bobbin transporting electric circuit 91 and a bobbin transporting electric circuit 92 for bobbins in the bypass circuit 8. The electric circuit further includes a switches 93-1 and 93-2 which are closed when a feeler 94 provided for the second bobbin stopping mechanism 90 detects presence of a bobbin, a relay 95 which is turned on when the feeler 94 is closed, another switch 96 which is closed when the relay 95 is turned on, normally closed switches 97-1, 97-2 and 97-3 are opened when a relay 98 which is described hereinafter is turned on, a further switch 99 which is provided for the bobbin remover 20 is closed when a carrier is detected, a further normally closed switch 100, and a relay 101 which is turned on when all of the switches 96, 97, 99 and 100 are closed for closing still further switches 102 and 103. If the switch 103 is closed, a solenoid for the second bobbin stopping mechanism 90 operates to allow transportation of an empty bobbin. The electric circuit further includes switches 104-1 and 104-2 which are closed when a feeler 105 provided for the first bobbin stopping mechanism 89 detects presence of a spinning bobbin 14*d*. When the switch 104 is closed, a timer 106 is turned on. The timer 106 is provided to open a normally closed switch 107 after lapse of a predetermined period of time, and it is opened if the feeler 105 does not detect any spinning yarn 14*d* within a predetermined period of time. The electric circuit further includes a switch 108 of a push-type button (not shown located at a suitable position of the system, and if the switch 108 is thrown in, the relay 98 is turned on to open the switch 97 of the electric circuit for empty bobbins. In other words, transportation of empty bobbins is stopped. The electric circuit further includes a time switch 114 which is closed for a predetermined period of time by a timer 116 which is turned on when the switch 104 is closed. A switch 110 is closed when the relay 101 for the circuit for empty bobbins is turned off, and if the switches 114, 110, 97 and 179 are all closed, then the relay 111 is turned on to close switches 112 and 113 to render a solenoid for the first bobbin stopping mechanism 89 operative to thus operate the stopper. As a result, spinning bobbins 14*d* in the bypass circuit 8 are released from stopping against advancement and are thus transported toward the bobbin remover 20. Such transportation of bobbins in the bypass circuit 8 is continued while the feeler 105 detects presence of a bobbin, and in the meantime, the empty bobbin transporting electric circuit 91 is held open. A transporting path 114 for transporting bobbin with remaining yarns is provided for feeding bobbins with remaining yarns from which yarns have not been unwound completely by a winder (not shown) from the returning path 5 for empty bobbins into the bypass circuit 8, and a movable gate 25 is located at a branch point of the transporting path 21.

Operations of the bobbin transporting and treating system of the present invention will be described below in conjunction with the embodiment described above.

Figure 8:
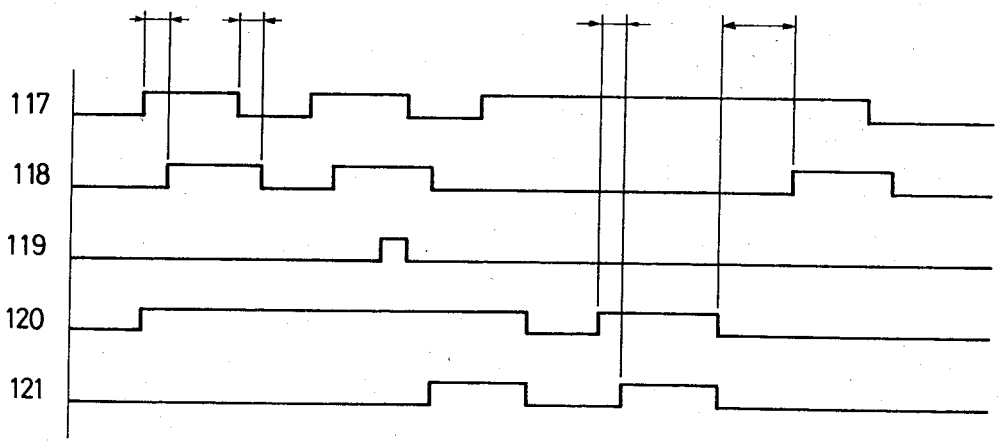
FIG. 8 is a time chart of the electrical circuit diagram of FIG. 7.

From a spinning bobbin B supplied from the transporting path 6 to the yarn end finding device 2, an end of a yarn is found and picked up by the yarn end finding device 2. Whether such picking up of a yarn end has been effected successfully or unsuccessfully is detected by the picking up detecting feeler F which operates each time a cam shaft of the yarn end finding device 2 makes a rotation. In the case of a bobbin B from which a yarn end has been picked up successfully, it is introduced into the bobbin supplying path 3 as the movable gate 29 is opened and thus advances toward the winder not shown. On the contrary, in the case of a bobbin carrier 14*d* from which a yarn end has not been picked up successfully, it is detected by the feeler F which thus instructs the movable gate 29 to open to a position in which it extends into the bobbin supplying path 3 so that the movable gate 29 introduces the bobbin 14*d* into the bypass circuit 8. The bobbin 14*d* thus introduced into the bypass circuit 8 normally passes by the bobbin remover 20 and is fed into the transporting path 6 by means of which it is supplied to the yarn end finding device 2 again. However, either if picking up of a yarn end has failed for a preset number of times, for example five, of successive bobbins or each time a predetermined period of time, for example one hour, elapses, all of spinning bobbins 14*d* in the bypass circuit 8 are discharged outside the transporting path system by the bobbin remover 20. If an operator finds that there remain in the bypass circuit 8 one or more bobbin carriers 14*d* from which yarn ends were not picked up successfully after empty bobbins have been removed from empty bobbin carriers 14*a* by the bobbin remover 20, then the bobbin carriers 14*d* will be adjusted by the operator. After completion of such adjustment of all of the bobbin carriers 14*d*, a push button not shown will be depressed. Referring to FIG. 7, by closing of the button switch 104, the relay 106 is turned on to open the switch 97 of the empty bobbin transporting electric circuit 91. As a result, the second bobbin stopping mechanism now stops transportation of empty bobbin carriers 14*a*. At the same time, upon detection of presence of a bobbin carriers 14*d* by the feeler 105, the switch 104 is closed to turn the relay 116 on to close the switch 109 to open the electric circuit 91 for empty bobbins. As a result, the relay 101 is turned on to close the switch 110 while the relay 98 is turned on to close the switch 97. In this way, all of the switches 114, 110, 97 and 179 are closed, and as a result, the relay 11 is turned on to close the switch 113 thereby to allow the bobbin carrier 14*d* in the bypass circuit 8 to be fed one after another to the bobbin remover 20. The bobbin carriers 14*d* thus fed to the bobbin remover 20 pass thereby and advance into the transporting path 6 so that they are supplied to the yarn end finding device 2 thereby. If the feeler 105 detects presence of a bobbin carrier 14*d* within a predetermined period of time, transportation of a bobbin or bobbins 14*d* in the bypass circuit 8 is continued. If all of the spinning bobbins 14*d* in the bypass circuit 8 have been fed out therefrom, the switch 104 is opened to turn the relay 116 off to open the switch 109. As a result, relay 111 is turned off to thus stop preferential transportation of bobbins 14*d* in the bypass circuit 8, and then if the feeler 94 for the empty bobbin returning path 5 detects presence of a bobbin or bobbins, the empty bobbin transporting electric circuit 91 is closed so that empty bobbins 14*a* are fed out to the bobbin remover 20. FIG. 8 is a timing chart illustrating such operations as described above, and a line 117 presents a high level when the feeler 94 detects presence of any empty bobbin, and another line 118 presents a high level when an empty bobbin carrier 14*a* is transported and indicates that an empty bobbin carrier 14*a* is supplied to the bobbin remover 20 a little later after the feeler 94 has detected presence of the empty bobbin carrier 14*a*. A further line 119 presents a high level when the switch 108 of the push button is closed. The lines 117, 118 and 119 indicate that in case the button switch 108 is depressed, then no empty bobbin carrier 14*a* is supplied to the bobbin remover 20 even if the feeler 94 detects presence of a bobbin or bobbins 14*a*. Meanwhile, a line 120 presents a high level when the feeler 105 for the branch path 8 detects presence of a bobbin carrier 14*d*, and another line 121 presents a high level when a bobbin carrier 14*d* in the bypass circuit 8 is fed out toward the bobbin remover 20. The lines 119, 120 and 121 indicate that upon depression of the button switch 108, a bobbin carrier 14*d* in the bypass circuit 8 is fed out toward the bobbin remover 20 and it can be seen from the lines 117 and 118 that in the meantime, transportation of empty bobbins is held stopped. In addition, it is also indicated that if all of spinning bobbin carriers 14*d* in the bypass circuit 8 have been fed out and hence the feeler 105 cannot detect presence of a bobbin carrier 14*d*, then if the feeler 94 for the empty bobbin carrier returning path 5 detects presence of an empty bobbin 14*a*, then transportation of empty bobbins 14*a* is started again.

As apparent from the foregoing description, a bobbin transporting system according to the present invention includes a branch path connected to entrance and exit sides of a yarn end finding device such that spinning bobbins from which ends of yarns have not been picked up successfully by the yarn end finding device can be automatically transported back to the yarn end finding device again, the branch path being joined to an empty bobbin transporting path to which a bobbin remover is connected so that bobbins from which yarn ends have not been picked up successfully may pass through the bobbin removing device, whereby if such a situation occurs as spinning bobbins from which yarn ends have not been picked up successfully appear in succession, all of such spinning bobbins can be discharged outside the transporting path system and then after all of such spinning bobbins from which yarn ends were not picked up successfully have been adjusted by an operator, all of the thus adjusted spinning bobbins can be fed out toward the bobbin remover prior to transportation of empty bobbins. Thus, if an operator leaves the system after bobbins from which yarn ends were not adjusted successfully have been adjusted, all of the spinning bobbins thus adjusted are immediately fed out from the bypass circuit. Accordingly, if there are in the bypass circuit some spinning bobbins from which yarn ends have not been picked up successfully when the operator comes back to the system, they are apparently spinning bobbins which have not yet been adjusted. Hence, the bobbin transporting system of the invention can present an effect that such a wasteful operation as spinning bobbins already adjusted are adjusted again can be prevented completely.

What is claimed is:

1. A bobbin and carrier transporting system, comprising: a winder, a bobbin yarn end readying device, a bobbin remover, a spinning bobbin supply station, a bobbin supplying path for transporting bobbins and carriers from said bobbin yarn end readying device to said winder, a returning path for feeding back to said bobbin yarn end readying device bobbins and carriers discharged from said winder, a bobbin carrier discharging path branched from said bobbin supplying path for transporting bobbin carriers carrying bobbins from which yarn ends have not been readied successfully by said yarn end readying device, a bypass path branched from said bobbin supplying path for transporting bobbins and carriers from said bobbin carrier discharging path to said returning path, and a branch path connecting a beginning end of said bypass path to said returning path, said bobbin remover, said spinning bobbin supplying station and said yarn end readying device being located adjacent said returning path.

2. A bobbin transporting system as claimed in claim 1 further comprising a bobbin carrier selecting means located adjacent the entrance of said discharging path for detecting a bobbin on which a yarn end has been improperly readied by said yarn end readying device and directing said bobbin to said discharging path.

3. A bobbin transporting system as claimed in claim 1 or 2, further comprising an empty bobbin carrier selecting means located adjacent the entrance to said branch path for detecting a bobbin having a residual amount of yarn thereon and directing said bobbin to said bypass path.

4. A bobbin transporting system as claimed in claim 1, wherein said remover is located adjacent the intersection of said bypass path and said returning path, said remover comprising pulling means for pulling a bobbin off a bobbin carrier and removing said bobbin from said transporting system.

5. A bobbin transporting system as claimed in claim 4, wherein said remover removes bobbins from carriers after a predetermined number of the bobbins and carriers are transported to said bypass path.

6. A bobbin transporting system as claimed in claim 4, wherein said remover removes bobbins from carriers after a predetermined period of time.

7. A bobbin transporting system as claimed in claim 4 further comprising, a first bobbin stopping mechanism located adjacent said bypass path and said returning path and a second bobbin stopping mechanism located adjacent said returning path.

8. A transporting system for transporting bobbins disposed on carriers comprising:

a winder;

a yarn end readying device;

a supply path along which bobbins and carriers may be tranported from said readying device to said winder;

a return path along which bobbins and carriers may be transported from said winder to said readying device;

a discharge path having one end adjacent said supply path along which bobbins and carriers may be transported from said supply path;

a bypass path having a first end adjacent said discharge path and a second end adjacent said return path along which bobbins and carriers may be transported from said discharge path to said return path;

a branch path having a first end adjacent said return path and a second end adjacent said bypass path along which bobbins and carriers may be transported from said return path to said bypass path;

first selection means adjacent said end of said discharge path for directing bobbins and carriers from said supply path to said discharge path;

second selection means adjacent said first end of said branch path for directing bobbins and carriers from said return path to said bypass path;

bypass path retention means adjacent said second end of said bypass path for preventing movement of bobbins and carriers from said bypass path to said return path.

9. A system as in claim 8 further comprising bobbin removal means located adjacent said return path between said second end of said bypass path and said yarn end readying device for removing bobbins from carriers transported on said return path.

10. A system as in claim 9 further comprising return path retention means located adjacent said return path between said removal means and said winder for preventing movement of bobbins and carriers on said return path to said removal means.

* * * * *